US008533959B2

(12) United States Patent
Davis

(10) Patent No.: US 8,533,959 B2
(45) Date of Patent: Sep. 17, 2013

(54) CARTRIDGES AND RAZORS WITH TRIMMING WING

(75) Inventor: Stuart Michael Davis, Norfolk, MA (US)

(73) Assignee: The Gillette Company, Boston, MA (US)

( * ) Notice: Subject to any disclaimer, the term of this patent is extended or adjusted under 35 U.S.C. 154(b) by 182 days.

(21) Appl. No.: 13/233,133

(22) Filed: Sep. 15, 2011

(65) Prior Publication Data

US 2012/0084984 A1 Apr. 12, 2012

Related U.S. Application Data

(60) Provisional application No. 61/391,704, filed on Oct. 11, 2010.

(51) Int. Cl.
*B26B 19/00* (2006.01)
*B26B 21/12* (2006.01)

(52) U.S. Cl.
USPC ..... 30/34.1; 30/50

(58) Field of Classification Search
USPC ..... 30/34.1, 48, 50, 527, 537, 540
See application file for complete search history.

(56) References Cited

U.S. PATENT DOCUMENTS 228,829 A * 6/1880 Moody ..... 30/50
816,141 A * 3/1906 Wiesenfeld ..... 30/50
1,076,375 A * 10/1913 Kaufmann ..... 30/50
1,241,921 A * 10/1917 Carroll ..... 30/50
1,387,465 A * 8/1921 Browning ..... 30/48
1,494,998 A * 5/1924 Crough ..... 30/50
1,506,533 A * 8/1924 Klecka ..... 30/48
1,589,826 A * 6/1926 Strand ..... 30/48
2,502,062 A * 3/1950 Rieger ..... 30/50
2,517,028 A * 8/1950 Ridner, Sr. ..... 30/50
2,587,964 A * 3/1952 Burns ..... 30/30
3,412,464 A * 11/1968 Keck ..... 30/50
4,534,110 A * 8/1985 Glass ..... 30/50
4,791,724 A * 12/1988 Dumas ..... 30/48
4,854,042 A * 8/1989 Byrne ..... 30/34.1
4,901,437 A * 2/1990 Iten ..... 30/50
4,993,153 A * 2/1991 Henry ..... 30/50
5,343,622 A * 9/1994 Andrews ..... 30/50
5,426,853 A 6/1995 McNinch (Continued)

FOREIGN PATENT DOCUMENTS

CN 103153558 A * 6/2013
DE 3733486 A1 10/1987
DE 102005010848 A1 9/2006
WO WO 2012051028 A1 * 4/2012

OTHER PUBLICATIONS

PCt International Search Report with Written Opinion in corresponding Int'l appln. PCT/US2011/055014 dated Dec. 27, 2011.

*Primary Examiner* — Jason Daniel Prone
(74) *Attorney, Agent, or Firm* — Kevin C. Johnson; Steven W. Miller

(57) ABSTRACT

A cartridge or razor, suitable for wet or dry shaving, comprising a housing in which the housing comprises a front, a rear, a first side, a second side opposite the first side, and a wing on at least one of the first side and the second side. The cartridge or razor also comprises one or more shaving blades disposed in the housing and at least one trimming blade disposed in the wing.

13 Claims, 6 Drawing Sheets

(56) References Cited

U.S. PATENT DOCUMENTS

| | | | | |
|---|---|---|---|---|
| 5,454,164 | A | 10/1995 | Yin et al. | |
| 5,522,137 | A * | 6/1996 | Andrews | 30/50 |
| 5,713,131 | A | 2/1998 | Rogers et al. | |
| 6,082,007 | A * | 7/2000 | Andrews | 30/50 |
| 6,125,857 | A * | 10/2000 | Silber | 30/34.1 |
| 6,141,875 | A * | 11/2000 | Andrews | 30/50 |
| D435,316 | S * | 12/2000 | Chenvainu et al. | D28/48 |
| 6,298,558 | B1 | 10/2001 | Tseng et al. | |
| 6,298,559 | B1 | 10/2001 | Kwiecien et al. | |
| 6,418,623 | B1 * | 7/2002 | Marcarelli | 30/50 |
| 6,434,828 | B1 * | 8/2002 | Andrews | 30/50 |
| 6,550,148 | B2 * | 4/2003 | Cecil | 30/50 |
| 6,754,958 | B2 | 6/2004 | Haws et al. | |
| 6,868,610 | B2 * | 3/2005 | Brandt et al. | 30/34.05 |
| 7,086,160 | B2 * | 8/2006 | Coffin et al. | 30/50 |
| 7,131,202 | B2 | 11/2006 | Pennell et al. | |
| 7,540,087 | B2 | 6/2009 | Rawle | |
| 7,617,607 | B2 | 11/2009 | Pennell et al. | |
| 7,690,122 | B2 | 4/2010 | Worrick, III et al. | |
| 7,721,451 | B2 * | 5/2010 | Psimadas et al. | 30/34.1 |
| 7,739,797 | B2 | 6/2010 | Rawle | |
| 7,761,999 | B2 * | 7/2010 | Macove | 30/34.1 |
| 8,387,259 | B2 * | 3/2013 | Starr | 30/34.1 |
| 2003/0182802 | A1 * | 10/2003 | Vega et al. | 30/50 |
| 2005/0022386 | A1 * | 2/2005 | Macove | 30/50 |
| 2008/0072431 | A1 | 3/2008 | Ozenick | |
| 2008/0172878 | A1 * | 7/2008 | Luxton | 30/34.1 |
| 2009/0013534 | A1 * | 1/2009 | Mallaridas | 30/50 |
| 2009/0178281 | A1 | 7/2009 | Moore | |
| 2009/0255124 | A1 * | 10/2009 | Hasbani | 30/50 |
| 2010/0077619 | A1 | 4/2010 | Follo et al. | |
| 2010/0107416 | A1 | 5/2010 | Follo | |
| 2012/0291289 | A1 * | 11/2012 | Glezerman | 30/537 |
| 2012/0324733 | A1 * | 12/2012 | Coresh | 30/50 |
| 2013/0000127 | A1 * | 1/2013 | Coresh | 30/50 |
| 2013/0152400 | A1 * | 6/2013 | Nunez | 30/50 |

* cited by examiner

PRIOR ART

PRIOR ART

CARTRIDGES AND RAZORS WITH TRIMMING WING

CROSS REFERENCE TO RELATED APPLICATION(S)

This patent application claims priority to U.S. Provisional Application No. 61/391,704, filed Oct. 11, 2011.

FIELD OF THE INVENTION

The invention generally relates to cartridges and razors, more particularly to wet shaving cartridges and razors with a trimming blade.

BACKGROUND OF THE INVENTION

Recent advances in shaving razors, such as a 5-bladed razor for wet shaving, may provide for closer, finer, and more comfortable shaving. Increasing the number of blades, however, may also increase the height of the cartridge of the wet shaving razor. Moreover, razors may include a lubrication strip disposed above the blades, which further increases the height of the cartridge. In such razors shaving or trimming in hard-to-reach or tight areas, for example, under the nose or at the edges of the mouth, may be cumbersome and less precise. For instance, when shaving under the nose, the height of the cartridge may be only slightly smaller than the distance between the nose and the mouth.

Current approaches to trimming only slightly reduce the height of the cartridge or include an additional blade on the top of the cartridge. Such approaches, however, may provide additional complexities to shaving and to trimming Examples of shaving razors with various approaches to trimming are described in U.S. Patent Application Publication Nos. 2010/0107416 and 2010/0077619 and U.S. Pat. Nos. 7,540,087, 7,617,607, 7,739,797, and 7,761,999.

What is needed, then, is a shaving cartridge and razor, such as a wet shaving razor or a powered wet shaving razor, comprising a portion of narrower height with a trimming blade, such that the trimming blade can trim and shave areas (e.g., hard-to-reach or tight areas) more easily and simply.

SUMMARY OF THE INVENTION

In one aspect, the invention relates to a cartridge for a shaving razor, suitable for wet or dry shaving. The cartridge comprises a housing comprising a front, a rear, a first side, a second side opposite the first side, and a wing on at least one of the first side and the second side. The cartridge also comprises one or more shaving blades disposed in the housing and at least one trimming blade disposed in the wing.

The foregoing aspect can comprise one or more of the following embodiments. The wing can be flexibly attached to at least one of the first side and the second side or the wing can be integrally formed with at least one of the first side and the second side. The wing can comprise a tapered distal end. A height of a front of the wing can be less than a height of the front of the housing, preferably about 10% to about 50% of the height of the front of the housing, and even more preferably about 20% of the height of the front of the housing. The wing and at least one of the first side and the second side adjacent to the wing can be non-coplanar. For example, the wing and at least one of the first side and the second side adjacent to the wing can form an included angle of about 180 degrees to about 270 degrees such that a distal end of the wing can be disposed rearward of the front of the housing.

In another aspect, the invention relates to a razor for shaving. The razor comprises a handle and a housing operably connected to the handle. The housing comprises a front, a rear, a first side, a second side opposite the first side, and a wing on at least one of the first side and the second side. The razor also comprises one or more shaving blades disposed in the housing and at least one trimming blade disposed in the wing.

This aspect can comprise one or more of the following embodiments. The housing can be pivotably connected to the handle such that the housing pivots when in contact with a shaving surface. The wing can be flexibly attached to at least one of the first side and the second side. The wing can be removably connected to the handle. For example, the wing can be removably affixed to the handle. The wing can be integrally formed with at least one of the first side and the second side. The wing can comprise a tapered distal end. A height of a front of the wing can be less than a height of the front of the housing, preferably about 10% to about 50% of a height of the front of the housing, and even more preferably about 20% of the height of the front of the housing. The wing and at least one of the first side and the second side adjacent to the wing can be non-coplanar. For example, the wing and at least one of the first side and the second side adjacent to the wing can form an included angle of about 180 degrees to about 270 degrees such that a distal end of the wing can be disposed rearward of the front of the housing.

In still another aspect of the invention, a method of trimming a shaving surface using a shaving razor is provided. The method comprises applying one or more shaving blades disposed in the shaving razor along the shaving surface, rotating the shaving razor in only a single axis of rotation less than about 180 degrees such that a trimming blade engages the shaving surface, and applying the trimming blade along the shaving surface. In an embodiment of this aspect, the one or more shaving blades are not in operational engagement with the shaving surface when applying the trimming blade along the shaving surface.

BRIEF DESCRIPTION OF THE DRAWINGS

Other features and advantages of the present invention, as well as the invention itself, can be more fully understood from the following description of the various embodiments, when read together with the accompanying drawings, in which.

DETAILED DESCRIPTION OF THE INVENTION

As used herein, "shaving surface" comprises any part of mammalian skin that includes hair.

Except as otherwise noted, the articles "a," "an," and "the" mean "one or more."

Figure 1:
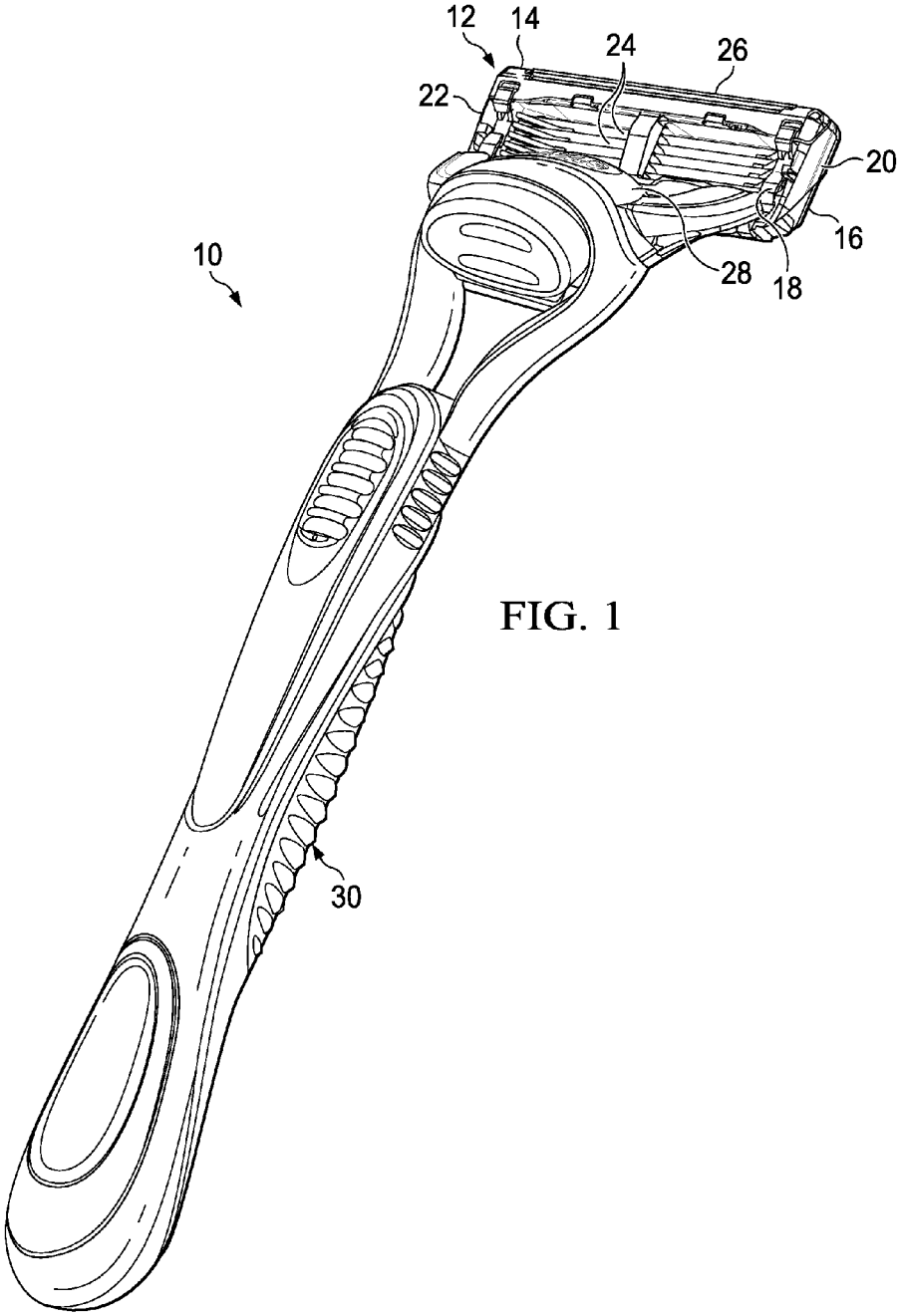
FIG. 1 is a schematic perspective view of a known shaving razor.
Figure 2:
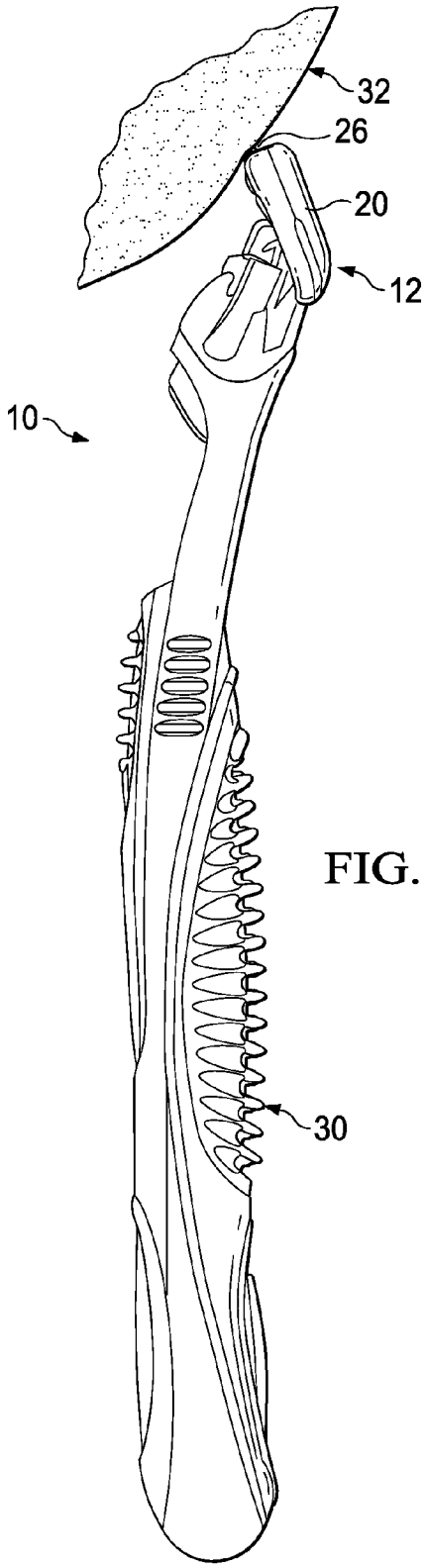
FIG. 2 is a schematic perspective side view of the known shaving razor of FIG. 1 applying a trimming blade to a shaving surface.

Referring to FIGS. 1 and 2, a known shaving razor 10 comprises a housing 12 with a top 14, a front 16, a rear 18, a first side 20, and a second side 22 opposite the first side 20. The housing 12 comprises shaving blades 24 disposed therein. The shaving blades 24 have a cutting edge exposed on the front 16 of the housing 12. A trimming blade 26 is disposed on the top 14 of the housing 12 with a cutting edge exposed on the top 14 of the housing 12. The housing 12 is mounted to a hood 28 of a handle 30. In operation, the known razor 10 can shave and trim a shaving surface 32 using the shaving blades 24 and the trimming blade 26, respectively.

Figure 3:
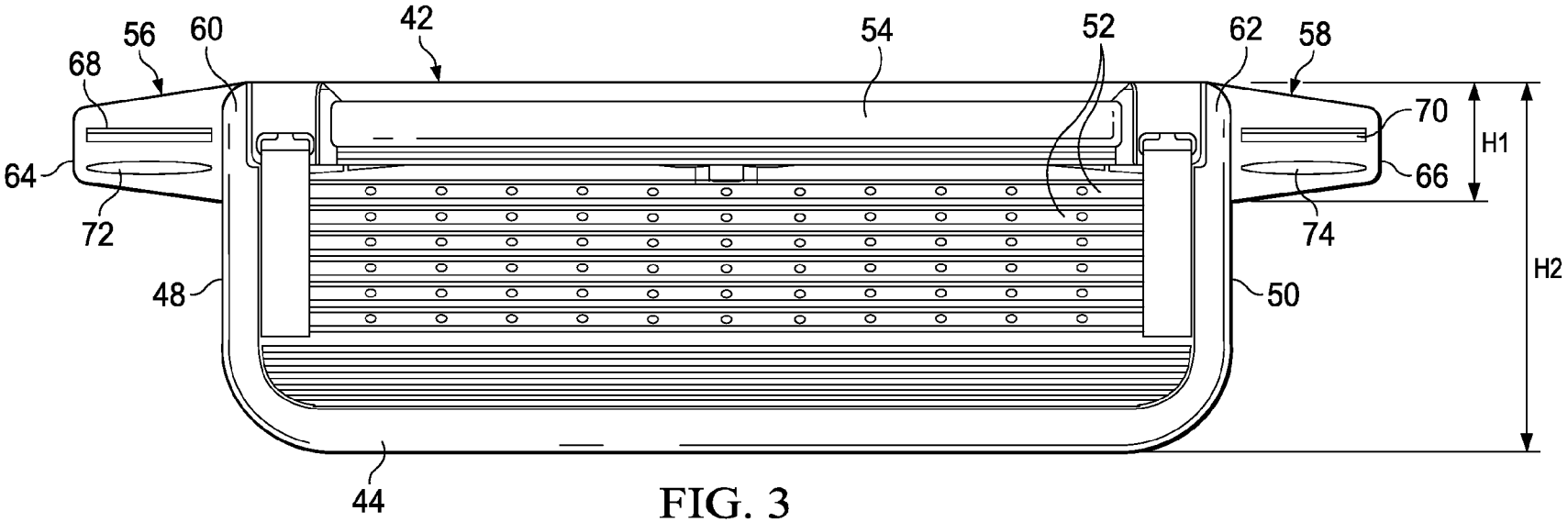
FIG. 3 is a schematic front view of a shaving cartridge in accordance with an embodiment of the invention.
Figure 4:
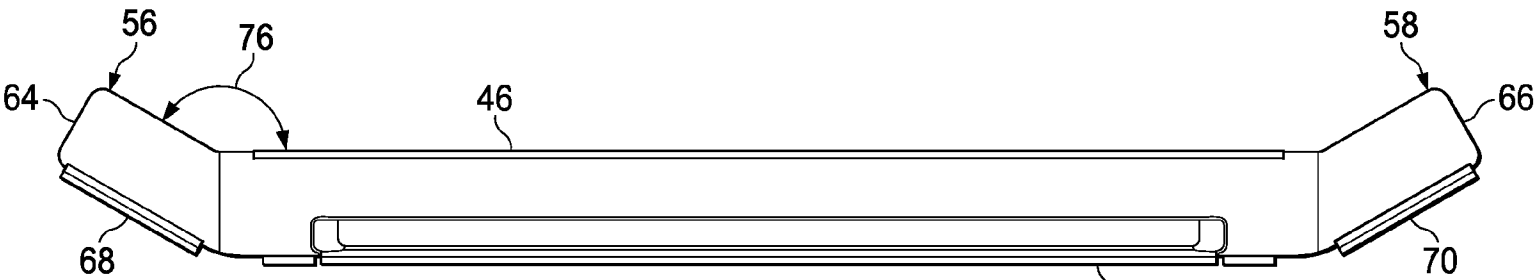
FIG. 4 is a schematic top view of the shaving cartridge of FIG. 3.

FIGS. 3 and 4 depict an embodiment of a cartridge of the present invention. The cartridge comprises a housing 42 with a front 44, a rear 46, a first side 48, and a second side 50 opposite the first side 48. One or more shaving blades 52 are disposed in the housing 42 such that each of the shaving blades 52 has a cutting edge exposed on the front 44 of the housing 42. Additionally or alternatively, a lubrication strip 54 may be disposed above the shaving blades 52 on the front 44 of the housing 42 to hydrate a shaving surface or to provide lubrication during shaving. Examples of lubrication strips are described in U.S. Pat. Nos. 5,454,164, 5,713,131, 6,298,558, 6,298,559, 6,754,958. The housing 42 also comprises a first wing 56 on the first side 48 and a second wing 58 on the second side 50. There are two wings in this embodiment, but cartridges may have fewer or more than shown. For example, a housing 42 of the present invention may comprise a wing on at least one of the first side 48 and the second side 50. As used herein, a wing refers to a projection or an extension from the first side or the second side of the housing. The wing comprises a front, a rear, a proximal end to the first side or the second side of the housing, and a distal end opposite the proximal end. Alternatively, the wing can project or extend from any part of the housing such as the front, the rear, etc. One or more dimensions of the wing are smaller than one or more dimensions of the front, the rear, the first side, or the second side of the housing. Examples include, but are not limited to, a height H1 of the front of the wing can be smaller than a height H2 of front of the housing, a length of the wing is smaller than a length of the housing between the first side and the second side, etc. In an embodiment, the wing can be integrally formed with or removably attached to the first side or the second side of the housing.

The wings 56, 58 may be located about a top portion 60 of the first side 48 and a top portion 62 of the second side 50. In an embodiment, a top of the wings 56, 58 may be flush with a top of the first side 48 and a top of the second side 50. Optionally, the wings 56, 58 may be located about a mid-section or a bottom of the first side 48 and the second side 50. Distal ends 64, 66 of the wings 56, 58 are tapered. Alternatively, a height of the distal ends 64, 66 of the wings 56, 58 can be enlarged or about the same height as the proximal ends. In one embodiment, the wings 56, 58 comprise trimming blades 68, 70 disposed therein, such that at least one trimming blade is disposed in each of the wings. Examples of trimming blades are described in U.S. Pat. Nos. 7,131,202, 7,540,087, 7,617,607, 7,690,122, 7,739,797, and 7,761,999.

Each of the trimming blades 68, 70 has a cutting edge exposed on a front of the wings 56, 58. In an embodiment, only the cutting edge of the trimming blades 68, 70 may be exposed, for example, such that the corners or ends of the trimming blades 68, 70 are concealed in the wings 56, 58 or covered by a small shield to avoid nicking. For example, in one embodiment, the trimming blades 68, 70 can be attached in the wings 56, 58 only at the end of the wings 56, 58 such that substantially most of a length of the trimming blades 68, 70 can be viewed from the front and the rear of the wings 56, 58. In such an embodiment, a user can more easily see placement of the trimming blades 68, 70 on the shaving surface, for example, with the aid of a mirror, which can provide for a more precise shave or trim. The length of each of the trimming blades 68, 70 may be smaller than a length of the shaving blades 52. The trimming blades 68, 70 may be parallel or coplanar with the shaving blades 52. Additionally or alternatively, the wings 56, 58 may define rinse channels 72, 74, such as apertures, adjacent or substantially adjacent the trimming blades 68, 70 so that water can rinse the trimming blades 68, 70. For example, substantially adjacent may be a distance of about 0.001 mm to about 10 mm Lubrication strips may also optionally be disposed on the wings 56, 58, for example, above the trimming blades 68, 70 on the front of the wings 56, 58.

To enhance trimming, the wings 56, 58 may generally have a height H1 smaller than a height H2 of the entire housing 42. A comparatively smaller height H1 for the wings 56, 58 may allow for more easily accessing and manipulating the wings in harder-to-reach or tight shaving areas and also provides for a longer trimming stroke than conventional multi-bladed razors. In embodiments where the wings 56, 58 are tapered, the height H1 of the wings 56, 58 is defined to be the height taken at the widest point. The height H1 of the front of the wings 56, 58 may preferably be about 10% to about 50% of the height H2 of the front 44 of the housing 42, and even more preferably about 20% of the height H2 of the front 44 of the housing 42. Additionally or alternatively, the height of the distal end 64 of the first wing 56 may be equal or unequal to the height of the distal end 66 of the second wing 58.

In an embodiment of the present invention, the distal ends 64, 66 of the wings 56, 58 are disposed rearward of the front 44 of the housing 42. For example, the front of each of the wings 56, 58 is non-coplanar with respect to the front 44 of the housing 42 or each of the trimming blades 68, 70 is non-coplanar with respect to the shaving blades 52. In this embodiment, the trimming blades 68, 70 are not in operational engagement with a shaving surface when the shaving blades 52 are engaged. An included angle 76 formed between one of the wings 56, 58 and the housing 42, e.g., using one of the trimming blades 68, 70 and the shaving blades 52 or the front of one of the wings 56, 58 and the front 44 of the housing 42 as reference points, can be about 45 degrees to about 180 degrees, preferably about 110 degrees to about 170 degrees, and even more preferably about 150 degrees. The included angle between the first wing 56 and the housing 42 and the included angle between the second wing 58 and the housing 42 may be equal or unequal.

The wings 56, 58 may be substantially rigid, flexible, resilient, or elastic with respect to the first side 48 and the second side 50 of the housing 42. In an embodiment in which the wings 56, 58 are substantially rigid with respect to the first side 48 and the second side 50 of the housing 42, manufacturing the housing 42 can be more simply accomplished with less steps and less materials if the housing 42 is made from the same material as the wing and therefore similarly substantially rigid. Additionally or alternatively, the wings 56, 58 may be integrally formed with the housing 42. Suitable methods for forming the housing 42 and the wings 56, 58 include molding, such as injection molding. In embodiments in which the wings 56, 58 are substantially flexible, resilient, or elastic with respect to the first side 48 and the second side 50 of the housing 42, the wings 56, 58 can be configured to not pivot when the front 44 of the housing 42 pivots when in contact with a shaving surface. This may allow the wings 56, 58 to be fixed in position to provide for a controlled trim in harder-to-reach or tight areas while allowing the front 44 of the housing 42 to pivot. For example, the wings 56, 58 may be connected to the first side 48 and the second side 50 via a rubber pin, hinge, snap-fit connection, friction-fit connection, male-female engagement, mating of corresponding, complementary shapes, etc.

Figure 5:
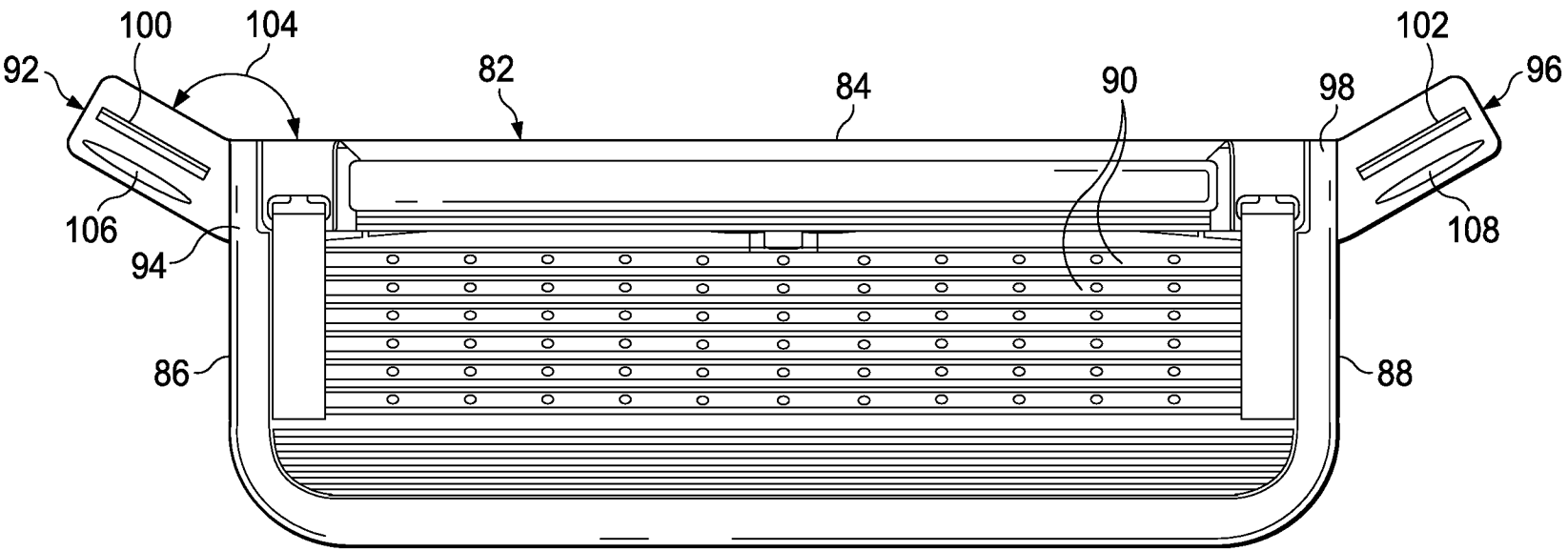
FIG. 5 is a schematic front view of a shaving cartridge according to another embodiment of the invention.

Referring now to FIG. 5, an embodiment of a cartridge of the present invention is shown. The cartridge comprises a housing 82 with a top 84, a first side 86 and a second side 88 opposite the first side 86. One or more shaving blades 90 are disposed in the housing 82. The housing 82 also comprises a first wing 92 on a top portion 94 of the first side 86 and a second wing 96 on a top portion 98 of the second side 88. The wings 92, 96 comprise trimming blades 100, 102. The wings 92, 96 are arranged such that a top of the first wing 92 and a top of the second wing 96 are above (e.g., rise above) the top 84 of the housing 82. In this embodiment, the trimming blades 100, 102 are non-coplanar or not parallel with the shaving blades 92. Alternatively, the wings 92, 96 can be arranged such that the top of the first wing 92 and the top of the second wing 96 are below (e.g., decline below) the top 84 of the housing 82, or the top of one of the wings is above the top 84 of the housing 82 while the top of the other wing is below the top 84 of the housing 82. An included angle 104 formed between the top of the first wing 92 or the top of the second wing 96 and the top 84 of the housing 82 can be about 90 degrees to about 270 degrees, preferably about 135 degrees to about 225 degrees, and more preferably about 150 degrees. The included angle between the top of the first wing 92 and the top 84 of the housing 82 and the included angle between the top of the second wing 96 and the top 84 of the housing 82 may be equal or unequal. Additionally or alternatively, the wings 92, 96 may define rinse channels 106, 108, such as apertures, adjacent or substantially adjacent the trimming blades 100, 102 so that water can rinse the trimming blades 100, 102.

Figure 6:
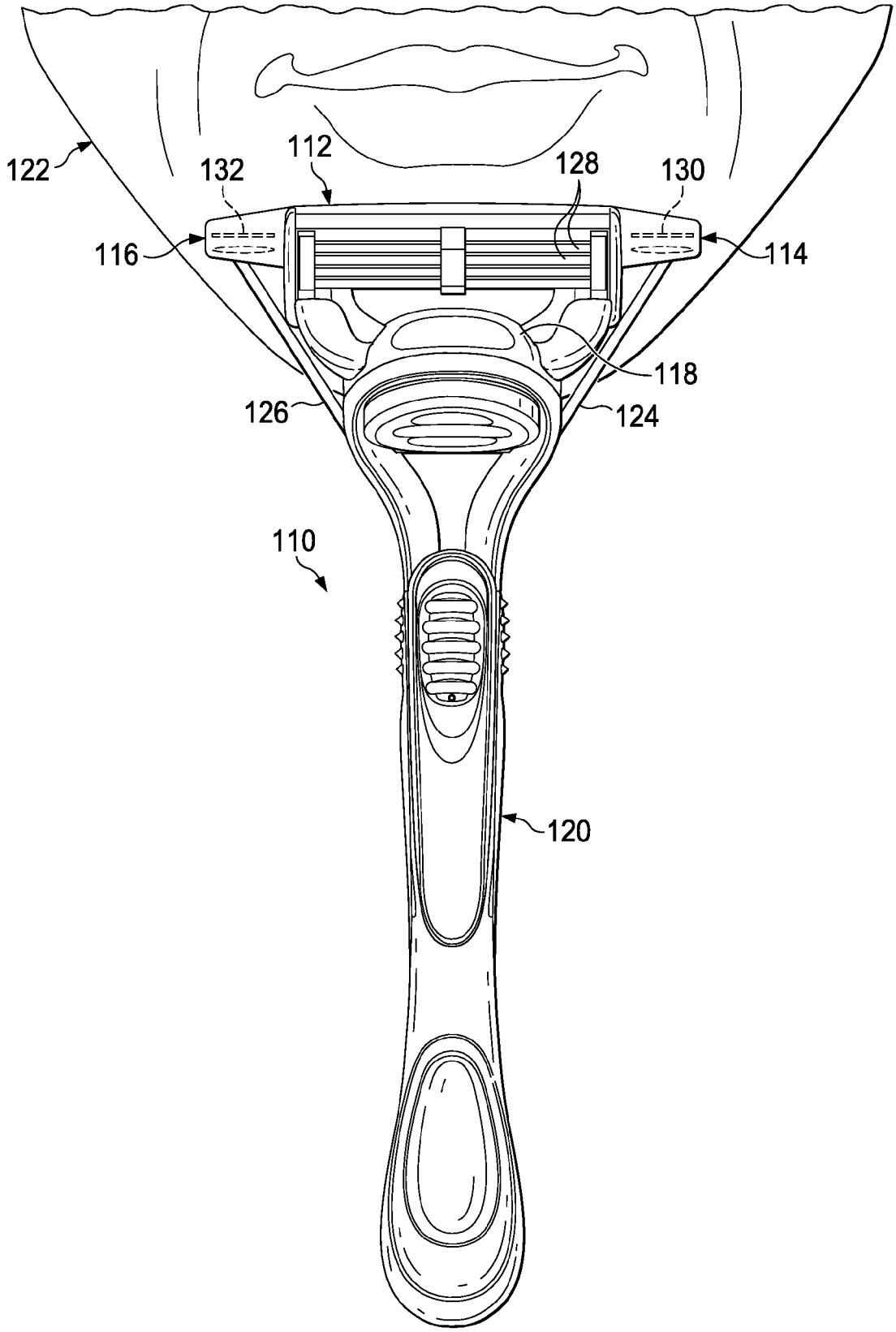
FIG. 6 is a schematic perspective view of a shaving razor in accordance with an embodiment of the invention.

FIG. 6 depicts an embodiment of a razor 110 of the present invention. The razor 110 comprises a cartridge according to any of the embodiments described herein, in which a housing 112 of the cartridge comprises wings 114, 116. The housing 112 is connected to a hood 118 of a handle 120. In an embodiment, the housing 112 is operably and removably connected to the handle 120, via the hood 118. For example, the housing 112 can be pivotably connected to the handle 120 such that the housing 112 pivots when in contact with a shaving surface 122. Optionally, connectors 124, 126 (e.g., struts, plates, pins, etc.) may connect the wings 114, 116 to the handle 120, for example, via the hood 118. The connectors 124, 126 may connect to the wings 114, 116 along any portion thereof, for example, at distal ends or proximal ends thereof, as well as on a bottom or a rear of the wings 114, 116. In this embodiment, the connectors 124, 126 may rigidly fix the wings 114, 116 to the handle 120 or the connectors 124, 126 may pivotably connect the wings 114, 116 to the handle 120. In an embodiment, the housing 112 can pivot with respect to the handle 120 when the housing 112 contacts the shaving surface 122, while the wings 114, 116 remain in a fixed position with respect to the handle 120. In this embodiment, one or both of the wings 114, 116 may be flexibly attached to a side of the housing 112. For example, the wings 114, 116 may be hingedly attached or foldably attached to a side of the housing 112. The connectors 124, 126 may be rigidly connected to the handle 120 via a snap-fit connection, friction-fit connection, male-female engagement, mating of corresponding, complementary shapes, etc.

Figure 7:
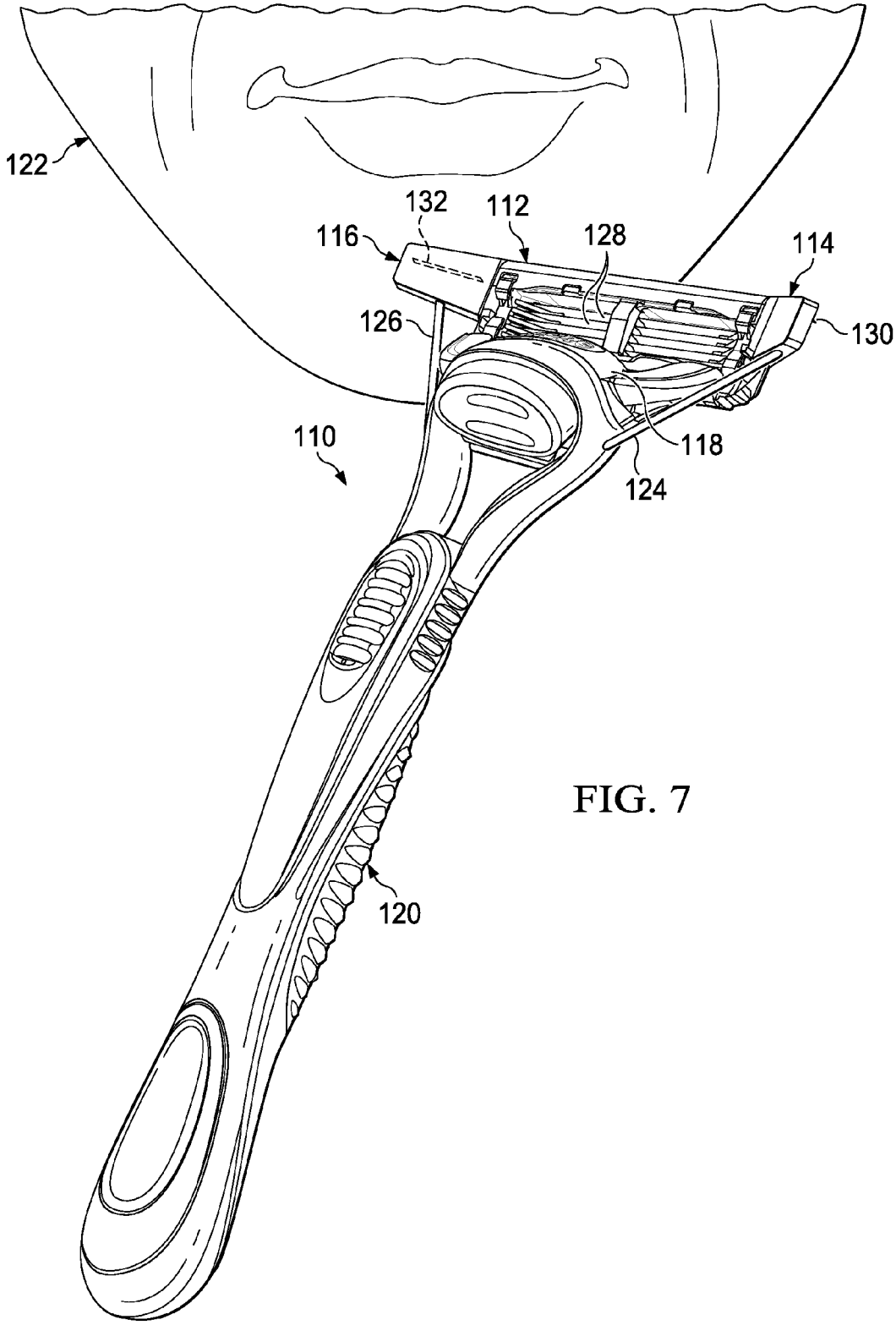
FIG. 7 is a schematic perspective view of the shaving razor of FIG. 6 applying a trimming blade applied to the skin.

Referring now to FIGS. 6 and 7, the housing 112 and one or more shaving blades 128 disposed therein can be applied to a shaving surface 122 for shaving. To utilize one of the trimming blades 130, 132 on the wings 114, 116, a user can rotate the handle 120 in only a single axis of rotation, whereby the rotation is less than about 180 degrees, such that one of the trimming blade 130, 132 engages the shaving surface 122 for trimming. In such an embodiment, the user can more easily and simply align and engage one of the trimming blades 130, 132 with the shaving surface 122. Additionally, when one of the trimming blades 130, 132 engages the shaving surface 122, the shaving blades 128 and the other trimming blade are not in operational engagement with the shaving surface 122. Alternative embodiments for shaving and trimming a shaving surface can include use of any of the embodiments of the cartridge and/or razor described herein.

It should be understood that every maximum numerical limitation given throughout this specification includes every lower numerical limitation, as if such lower numerical limitations were expressly written herein. Every minimum numerical limitation given throughout this specification includes every higher numerical limitation, as if such higher numerical limitations were expressly written herein. Every numerical range given throughout this specification includes every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cartridge for a shaving razor, the cartridge comprising:

a housing comprising a front, a rear, a first side positioned between the front and the rear, a second side opposite the first side positioned between the front and the rear, and a first wing projecting outward from the first side and a second wing projecting outward from the second side;

one or more shaving blades disposed in the housing; and at least one trimming blade disposed in the first wing and at least one trimming blade disposed in the second wing.

2. The cartridge of claim 1, wherein the first wing is flexibly attached to the first side and the second wing is flexibly attached to the second side.

3. The cartridge of claim 1, wherein the first wing comprises a tapered distal end.

4. The cartridge of claim 1, wherein a height of a front of the first wing is less than a height of the front of the housing.

5. The cartridge of claim 4, wherein the height of the front of the first wing is about 10% to about 50% of the height of the front of the housing.

6. The cartridge of claim 5, wherein the height of the front of the first wing is about 20% of the height of the front of the housing.

7. A razor for shaving, the razor comprising:

a handle;

a housing operably connected to the handle, the housing comprising a front, a rear, a first side positioned between the front and the rear, a second side opposite the first side positioned between the front and the rear, and a first wing projecting outward from the first side and a second wing projecting outward from the second side; and one or more shaving blades disposed in the housing; and at least one trimming blade disposed in the first wing and at least one trimming blade disposed in the second wing.

8. The razor of claim 7, wherein the housing is pivotably connected to the handle such that the housing pivots when in contact with a shaving surface.

9. The razor of claim 8, wherein the first wing is flexibly attached to the first side and the second wing is flexibly attached to the second side.

10. The razor of claim 7, wherein the first wing comprises a tapered distal end.

11. The razor of claim 7, wherein a height of a front of the first wing is less than a height of the front of the housing.

12. The razor of claim 11, wherein a height of a front of the first wing is about 10% to about 50% of a height of the front of the housing.

13. The razor of claim 12, wherein the height of the front of the first wing is about 20% of the height of the front of the housing.

* * * * *